US006722256B2

(12) United States Patent
Roberts et al.

(10) Patent No.: US 6,722,256 B2
(45) Date of Patent: Apr. 20, 2004

(54) REDUCED ICING VALVES AND GAS-DRIVEN MOTOR AND DIAPHRAGM PUMP INCORPORATING SAME

(75) Inventors: Charles O. Roberts, Edon, OH (US); Michael Conti, Bryan, OH (US); Nicholas Kozumplik, Jr., Bryan, OH (US); Gordon M. Schroeder, New Bavaria, OH (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 16 days.

(21) Appl. No.: 10/242,595

(22) Filed: Sep. 12, 2002

(65) Prior Publication Data

US 2004/0050242 A1 Mar. 18, 2004

(51) Int. Cl.[7] ..... F01L 15/14
(52) U.S. Cl. ..... 91/268; 91/286
(58) Field of Search ..... 91/268, 271, 286

(56) References Cited

U.S. PATENT DOCUMENTS 2,707,456 A * 5/1955 Schweisthal ..... 91/268
4,854,832 A 8/1989 Gardner et al.
5,584,666 A 12/1996 Kozumplik, Jr. et al.

* cited by examiner

*Primary Examiner*—Edward K. Look
*Assistant Examiner*—Michael Leslie
(74) *Attorney, Agent, or Firm*—Michael Best & Friedrich LLP

(57) ABSTRACT

A reduced icing valve for an gas-driven motor and a reciprocating double diaphragm pump is provided having a shiftable valve for alternatively supplying a motive gas through first and second supply ports to opposed first and second power pistons in opposed motive gas chambers, respectively, and for effecting alternating exhaust of the chambers. The shiftable valve is provided with an insert that deflects, away from the shiftable valve, air entering from each of the bypass valves until the bypass valves are fully actuated by the exhaust gas from the motive gas chambers. The shiftable valve is further provided with bypass valves independent of and intermediate the shiftable valve and each of the first and second motive gas chambers for bypassing the shiftable valve by exhaust gas from the motive gas chambers. The bypass valves are further actuated in an opposing direction by a supply source of motive gas to the chambers.

20 Claims, 4 Drawing Sheets

REDUCED ICING VALVES AND GAS-DRIVEN MOTOR AND DIAPHRAGM PUMP INCORPORATING SAME

BACKGROUND OF THE INVENTION

This invention relates generally to air valves and more particularly to air valves designed to minimize icing and improve efficiency for a diaphragm pump or the like.

This invention relates to an improved fluid operated, double diaphragm pump, and, more particularly, to the pilot valve construction for such a pump.

The use of a double diaphragm pump to transfer materials is known. Typically such a pump comprises a pair of pumping chambers with a pressure chamber arranged in parallel with each pumping chamber in a housing. Each pressure chamber is separated from its associated pumping chamber by a flexible diaphragm. As one pressure chamber is pressurized, it forces the diaphragm to compress fluid in the associate pumping chamber. The fluid is thus forced from the pumping chamber. Simultaneously, the diaphragm associated with the second pumping chamber is flexed so as to draw fluid material into the second pumping chamber. The diaphragms are reciprocated in unison in order to alternately fill and evacuate the pumping chambers. In practice, the chambers are all aligned so that the diaphragms can reciprocate axially in unison. In this manner the diaphragms may also be mechanically interconnected to ensure uniform operation and performance by the double acting diaphragm pump.

Various controls have been proposed as the major distribution valve for providing a pressurized motive fluid, e.g., pressurized air, to the chambers associated with the double acting diaphragm pump. An exemplary control is shown in commonly assigned U.S. Pat. No. 4,854,832, in which a double diaphragm pump has a major distribution valve which includes a spool actuator that receives a sliding "D" valve. The spool actuator has a series of different diameters so as to provide for actuation is response to pressure differential thereby shifting the "D" valve between passageways to fill and exhaust the air chambers that drive the pump.

In designing air motor valving used to control the feed air to and exhaust air from the diaphragm chambers of such pumps, however, it is desirable to exhaust the diaphragm chambers as quickly as possible in order to obtain a fast switch over and high average output pressures. To achieve rapid exhaust times, larger distribution valves such as a elastomer-fitted or close fit spool-type valves are typically provided having larger porting that permits the rapid exhausting of air. Large temperature drops are generated with these larger valves, however, which cause the valve to become extremely cold and can cause ice formation from moisture in the exhaust air.

In order to minimize icing and improve the efficiency of the pump, commonly assigned U.S. Pat. No. 5,584,666, discloses a diaphragm pump having air valves designed to divert cold exhaust air from the major distribution valve. These air valves are bypass check valves, also known as "quick dump" valves, which are used in conjunction with spool valves due to their ability to pass large volumes of air in a relatively small package.

However, spool-type valves consist of many parts, which include rubber seals, or can be of the type which use close or lap fits to eliminate the elastomeric seals. Elastomer-fitted spools function well in dirty wet air and will not leak air when the pump stalled against backpressure. The elastomers used in an elastomer-fitted spool, however, are susceptible to chemical attack from airborne lubricants, which can cause the valve to hang up or stick. The lapped or close-fit spools eliminate parts but typically require constant lubrication to prevent sticking and do not function well with dirty air. Because there also must be some clearance between the spool and housing, air leakage will occur when the pump is stalled against backpressure, thus wasting compressed air.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention this is accomplished by providing a reduced icing valve for a gas-driven motor and a reciprocating double diaphragm pump having a shiftable valve for alternatively supplying a motive gas through first and second supply ports to opposed first and second power pistons in opposed motive gas chambers, respectively, and for effecting alternating exhaust of the chambers. The shiftable valve is provided with an insert that deflects, away from the shiftable valve, air entering from each of the bypass valves until the bypass valves are fully actuated by the exhaust gas from the motive gas chambers. The shiftable valve is further provided with bypass valves independent of and intermediate the shiftable valve and each of the first and second motive gas chambers for bypassing the shiftable valve by exhaust gas from the motive gas chambers. The bypass valves are further actuated in an opposing direction by a supply source of motive gas to the chambers.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION OF THE INVENTION

According to the present invention, a reduced icing air valve is used having a major spool valve and valve plate combination to provide and exhaust motive air to and from an air motor. The present invention provides improvements to the diaphragm pumps and components shown and described in U.S. Pat. Nos. 4,854,832 and 5,584,666, the specifications of which are incorporated herein by reference.

According to a preferred embodiment of the present invention, an adapter plate is provided that permits the use of a "D" valve having a smaller valve insert than would otherwise be required while requiring fewer parts and the attendant difficulties provided by the typical spool valve constructions described above.

Figure 1:
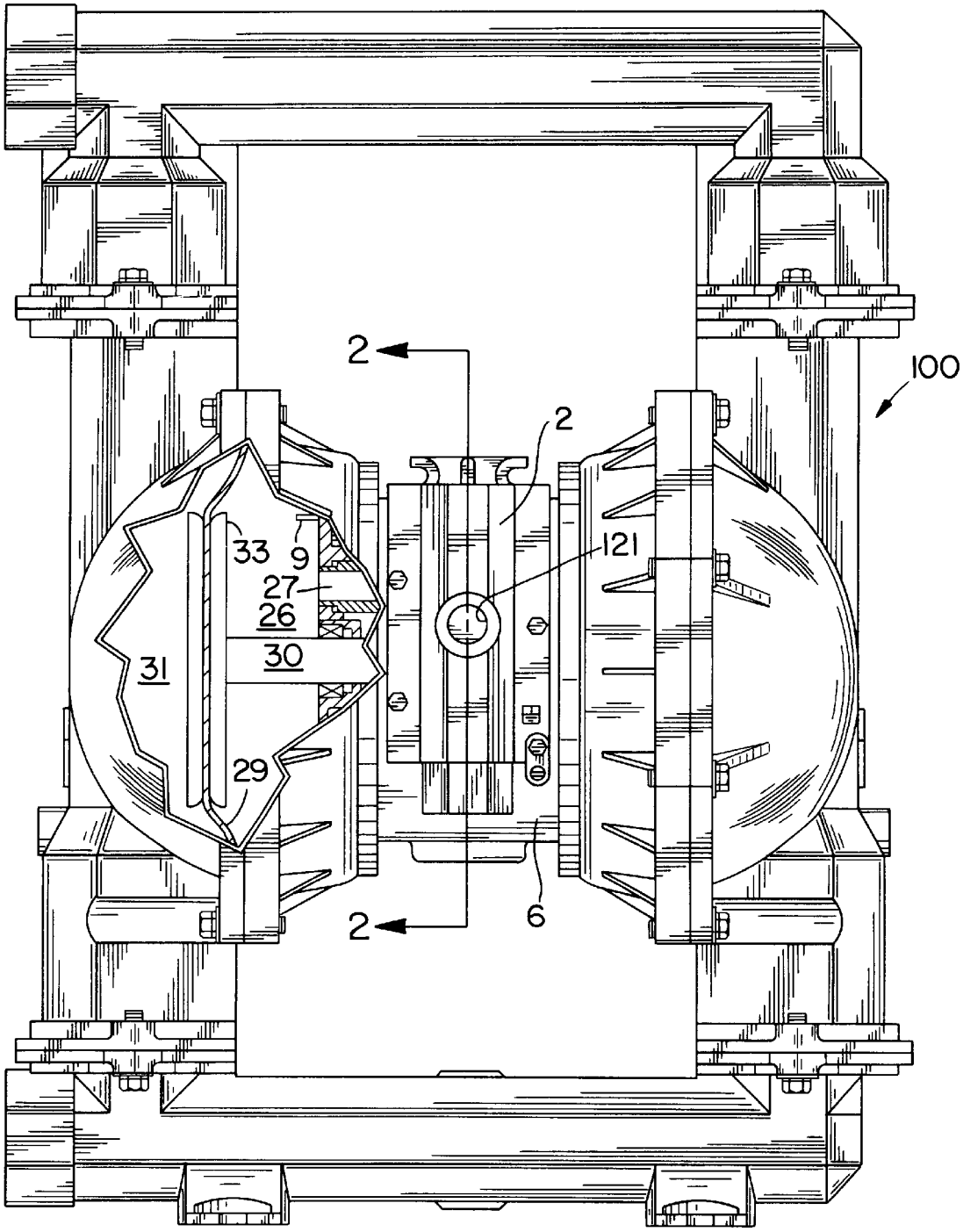
FIG. 1 is an elevational view of a diaphragm pump showing an air motor major valve according to the present invention and showing a housing chamber in partial section.

The drawings illustrate a typical double diaphragm pump incorporating the reduced icing air valve and major distribution valve construction of the present invention. Like numbers refer to like parts in each of the figures. Shown in FIG. 1 is a partial sectional view of a double diaphragm pump incorporating a main housing 100 that defines first and second opposed and axially spaced housing chambers. Each housing chamber includes a pressure chamber 26 and a fluid chamber 31 that are separated by a flexible diaphragm 29 as depicted by the partial sectional view of the left housing chamber in FIG. 1. The pressure chamber, fluid chamber, and diaphragm in the right housing chamber are similarly arranged and form a mirror image of those components in the left housing chamber.

Each of the diaphragms 29 is fashioned from an elastomeric material as is known to those skilled in the art. The diaphragms 29 are connected mechanically by means of a shaft 30 that extends axially through the midpoint of each of the diaphragms. The shaft 30 is attached to the diaphragm 29 by means of opposed plates 33 on opposite sides thereof. Thus, the diaphragms 29 will move axially in unison as the pump operates by the alternate supply and exhaust of air to the pressure chambers of the pump as discussed in greater detail in the '832 and '666 patents. In brief, upon reciprocating the diaphragms of the pump, fluid that passes into each fluid chamber from-associated inlet-check valves is alternately compressed within and forced outwardly through associated outlet check valves. Operation of the fluid check valves controls movement of fluid in and out of the pump chambers causing them to function as a single acting pump. By connecting the two chambers through external manifolds, output flow from the pump becomes relatively constant.

Figure 2:
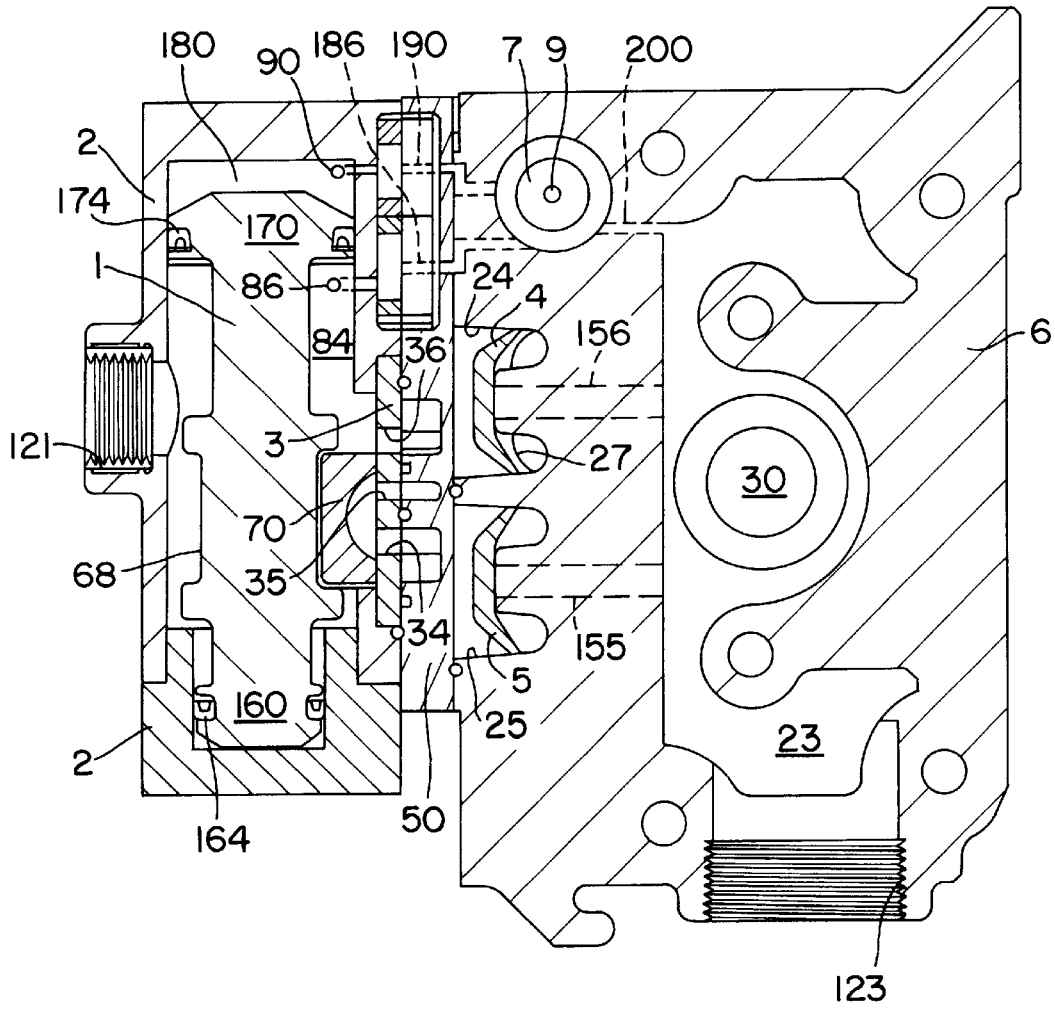
FIG. 2 is a cross sectional view taken along the section line "2—2" in FIG. 1, showing a reduced icing air valve according to the present invention having a major valve and bypass check valves.

The specific structure of the present invention relates to the construction of the reduced icing air valve and, more specifically, its major valve construction which provides and exhausts motive gas, respectively, to and from an air motor. Referring to FIG. 1, shown located between the left and right housing chambers is a center body housing 6 to which is attached to a valve block or body 2 having an air inlet 121. As shown in FIG. 2, valve block 2 is generally a two piece construction that facilitates the assembly of a major valve that is comprised of the valve block 2, a spool 1, a valve insert 70, a valve plate 3, quick dump or bypass check valves 4 and 5, and center body housing 6.

Spool 1 is a differential piston having a large diameter end 170 and a small diameter end 160 as shown in FIG. 2. Small diameter end 160 and large diameter end 170 include annular grooves having seals 164 and 174 which engage against the walls of a chamber 84 located in valve body 2. Spool 1 also includes an annular groove 68 which receives a valve insert 70 that extends through the wall of valve body 2 and slides against valve plate 3. The motion of valve insert 70 is limited by the wall of valve body 2 to correspond with the range of motion of the travel of the spool 1 in chamber 84. The valve insert 70 is constructed so as to alternately connect an exhaust aperture 35 with a first aperture 34 and a second aperture 36 defined through the valve plate 3. The spacing and position of valve insert 70 and the relative positions of exhaust aperture 35, first aperture 34, and second aperture 36 are such as to be consistent with the operation of the device as will be described below. Fluid pressure port 86 connects chamber 84 to provide air pressure from air inlet 121 to the pilot piston 7 during operation as described below which operates the double acting diaphragm pump.

Preferably, valve plate 3 and valve insert 70 are constructed of materials that are chemically inert and/or are internally lubricated to minimize chemical compatibility problems and reduce frictional loads, respectively, while also permitting the use of motive gas sources that are dirty.

Shown in FIG. 2 is an end view of a pilot valve consisting of a pilot piston 7 and an actuator pin 9 that extends into left pressure chamber 26 as shown in FIG. 1. Not shown is a second actuator pin that is located in line with and on the opposite side of pilot piston 7 and extends into the right pressure chamber. During operation of the pump, as the diaphragms reciprocate the diaphragm plates alternately contact the actuating pins causing the pilot piston 7 to shift position. This shift in position of pilot piston 7 causes pneumatic pilot signals received from port 86 and through passage 186 to be sent to the front face 180 of spool 1 via a passage 190 and a port 90 and, alternately, to exhaust chamber via passage 200. When a pilot signal is provided from port 86 to port 90 via pilot piston 7, spool 1 shifts left. When a signal is not provided to port 90, spool 1 shifts right due to supply air in chamber 84 acting on the back side of large diameter end 170. In this manner, pilot piston 7 causes spool 1 to shift within valve body 2 at the end of each pump stroke thereby alternating the exhausting and filling of the pressure chambers and their corresponding fluid chambers. Preferably, pilot piston 7 is a differential piston having a large diameter end and a small diameter end such that air pressure acting on the large diameter of the piston will force the piston to one side when a pilot signal from chamber 84 is not provided to port 90.

Quick-dump valves 4 and 5 are elastomeric check valves like those described in the '666 patent that sit in chambers 24 and 25, respectively. As shown in FIGS. 1 and 2, chamber 24 is in fluid communication with left pressure chamber 26 via port 27 and vented via port 156 to an exhaust chamber 23 that exhausts to atmosphere via an exhaust port 123. Chamber 25 is similarly vented to exhaust chamber 23 via port 155 and in fluid communication with right pressure chamber (not shown).

During operation of the pump, when spool 1 is in its extreme left position as shown in FIG. 2, supply air from inlet 121 passes through port 86, pilot piston 7, and passage 190 to port 90. The front face 180 of spool 1 is thereby connected to the chamber 84 and thus to a pressurized source of fluid to maintain the spool I in the position shown in FIG. 1. Simultaneously, because of the position of the valve insert 70, supply air from inlet 121 flows from chamber 84 through the second aperture 36 in valve plate 3 and into chamber 24. The air impinging on the upper surface of bypass check valve 4 forces it to seat and seal off exhaust port 156. The air flow also deforms the lips of the elastomeric check such that air flows around the valve into port 27 and into left pressure chamber 26. Thus, air pressure acting on the diaphragm 29 forces it to the left expelling fluid from the fluid chamber 31 through an outlet check valve. The shaft 30 likewise moves to the left as does the right diaphragm (not shown) which causes air to exhaust from the right pressure chamber. Pumped fluid is drawn into the right fluid chamber while fluid is pumped from the left fluid chamber 31.

At the same time left pressure chamber 26 is filling, the air above valve 5 has been exhausted up through the first aperture 34 in valve plate 3. Because valve insert 70 does not permit the air above the bypass check valve 5 to pass upward into valve body 2, the exhaust aperture 35 in valve plate 3 is connected to exhaust chamber 23 by porting. In this manner, the air above the quick dump valves is directed by valve insert 70 back down through the exhaust aperture 35 in valve plate 3 and ported to exhaust which causes a pressure differential to occur between chambers 24 and 25. The lips of valve 5 relax against the wall of chamber 25. By this configuration, the combination of a valve insert 70 with quick dump, bypass check valves 4, 5 is provided to permit the rapid exhaust of the pressure chambers through the quick dump valves and while using a minimum number of parts.

As air begins to flow from right pressure chamber upward through chamber 25, it forces valve 5 to move upward to seat against valve plate 3 and seal off chamber 25 from the major valve while also opening port 155. Exhaust air is dumped through port 155 into exhaust chamber 23.

As the diaphragms move to the left, movement of the actuator pin located in the right pressure chamber is effected due to engagement of diaphragm plate located therein, thereby forcing the pilot piston to shift. Upon such transfer, the exhaust passages 190 and 200 are connected by the pilot piston and, thus, open to exhaust chamber 23. In the absence of the pilot signal to port 90, the supply air pressure within chamber 84 exerted on the backside of large diameter end 170 causes spool 1, and valve insert 70 with it, to move right. Pressurized air then flows from air inlet 121 into chamber 25 causing the right pressure chamber to fill and the diaphragm located therein to move to the right. This in turn causes the connecting shaft 30 to move the left diaphragm 29 to the right, thereby exhausting the left pressure chamber 26 and causing the left fluid chamber 31 to fill.

The movement of plate 33 to the right in FIG. 1 will ultimately engage that plate with the actuator pin 9, thereby causing the pilot piston 7 and, in turn, spool 1 back again effecting movement to the left of the diaphragms and shaft 30. In this manner, the reversal of operation of the pump is effected, which will continue to oscillate or cycle as long as air is supplied through the inlet 121.

While the '666 Patent discusses the incorporation of valves including "D" valves into diaphragm pumps having quick dump valves, the efficient interconnection of such valves in combination is most desirable. In incorporating a "D" valve into an air motor, the size of the valve insert is dictated by the span between the passages to be connected. The size of the valve insert used, in turn, determines the amount of friction encountered by the insert when moving against the valve plate. When using a larger valve insert to direct a motive gas into and out of a motor, a larger force is exerted by the gas on the valve insert due to the larger area presented by the valve insert. This increased force increases the frictional force of the valve insert against the valve plate and makes its movement more difficult during pump operation thereby decreasing the efficiency of the pump as more air is required to create the increased force required. Thus, the use of a smaller valve insert is preferred to decrease the frictional forces acting on the "D" valve and increase the efficiency of the pump. However, the span of the passages to be connected in a diaphragm pump generally calls for the use of a larger valve insert.

Figure 3:
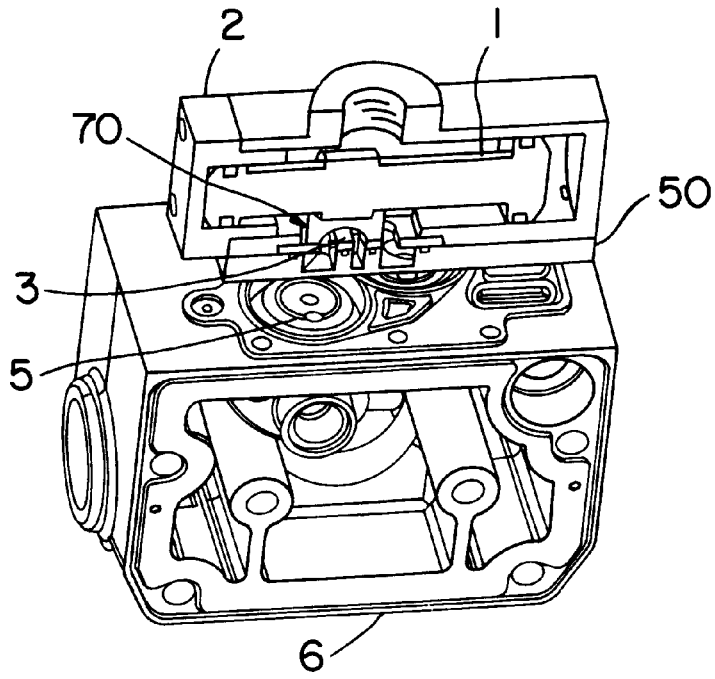
FIG. 3 is a partial sectional, perspective view showing the reduced icing air valve according to the present invention.
Figure 4:
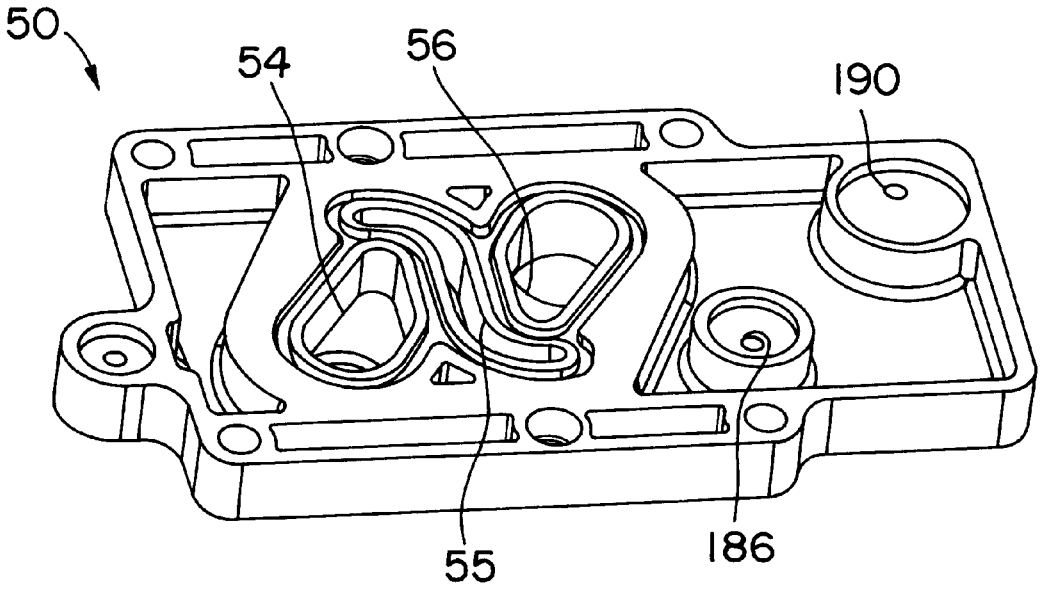
FIG. 4 is a perspective view showing an adapter plate according to one aspect according to the present invention.
Figure 5:
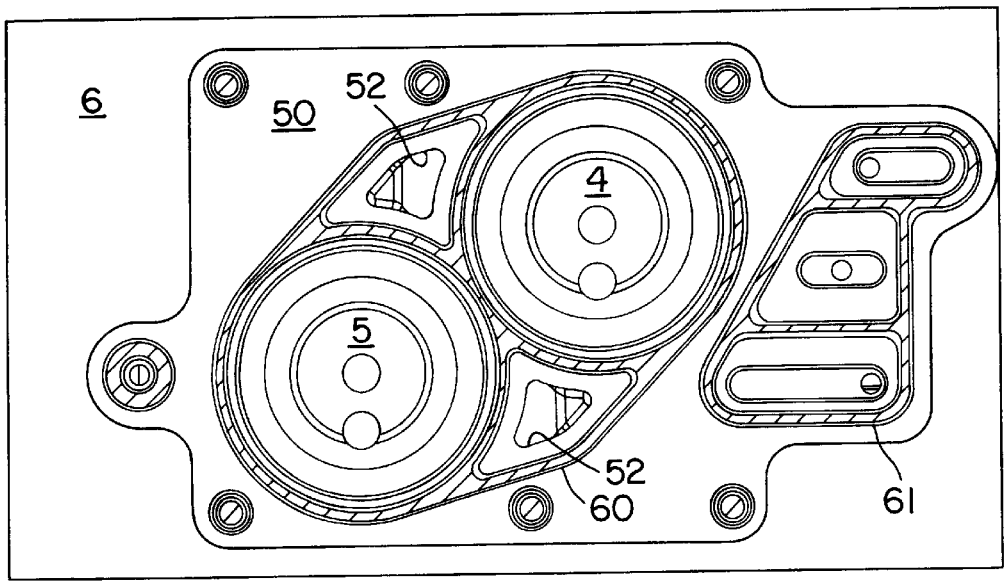
FIG. 5 is a top view of a center body housing of the diaphragm pump shown in FIG. 1.
Figure 6:
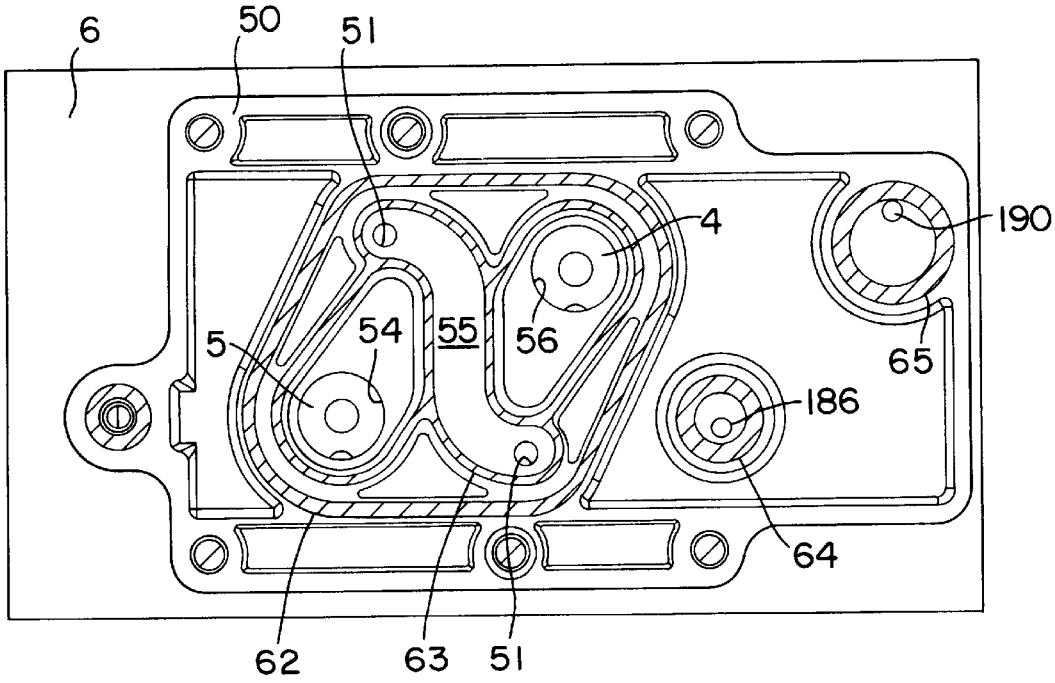
FIG. 6 is a top view of the adapter plate shown in FIG. 4 assembled to the top of the center body housing shown in FIG. 5.

According to a preferred embodiment of the present invention, the porting between the exhaust aperture 35 of valve plate 3 and exhaust chamber 23 may be achieved through an adapter plate 50, best seen in FIGS. 4 and 6, which minimizes the gap between the ports to be connected. Adapter plate 50 is shown in the sectional view of FIG. 3 disposed between valve plate 3 and bypass valves 4, 5. The adapter plate 50 comprises a first air path 54 and a second air path 56 that are in fluid communication with first aperture 34 and second aperture 36, respectively. As shown in FIGS. 5 and.6, an exhaust vent 55 having two exhaust ports 51 is located between the first air path 54 and second air path 56 and connects exhaust aperture 35 to exhaust via exhaust apertures 52 located in center body housing 6.

As shown in FIGS. 4 and 6, the exhaust vent 55 is, preferably, curvilinear-shaped and, most preferably, serpentine-shaped thereby minimizing the distance between said first and second air paths 54, 56. To provide air logic for shifting the shiftable valve, adapter plate 50 further comprises pilot signal paths 186, 190 for connecting a pilot valve in fluid communication with the shiftable valve. Gaskets 60, 61, 62, 63, 64, and 65 are provided as shown in FIGS. 5 and 6 to seal interconnecting air passages upon assembly of the center body housing 6, adapter plate 50, valve plate 3, and valve body 2.

There has been set forth a preferred embodiment of the invention. However, the invention may be altered or changed without departing from the spirit or scope thereof. The invention, therefore, is to be limited only by the following claims and their equivalents.

What is claimed is:

1. A reduced icing valve for a gas-driven motor comprising:

a shiftable valve for alternatively supplying a motive gas through first and second supply ports to opposed first and second power pistons in opposed motive gas chambers, respectively, and for effecting alternating exhaust of said chambers;

said shiftable valve being further provided with bypass valves independent of and intermediate said shiftable valve and each of said first and second motive gas chambers for bypassing said shiftable valve by exhaust gas from said motive gas chambers, and an insert that deflects, away from said shiftable valve, air entering from each of said bypass valves until said bypass valves are fully actuated by said exhaust gas from said motive gas chambers; and said bypass valves being further actuated in an opposing direction by a supply source of motive gas to said chambers.

2. The reduced icing valve according to claim 1, wherein said air deflected by said insert is ported to exhaust.

3. The reduced icing valve according to claim 1, wherein said insert is a "D" valve.

4. The reduced icing valve according to claim 3, further comprising a valve plate against which said "D" valve slides, said valve plate having first and second apertures in fluid communication with said first and second supply ports, respectively, and an exhaust aperture located between said first and second apertures and connected to exhaust, wherein as said shiftable valve shifts, said "D" valve reciprocates to alternately connect said first and second apertures with said exhaust aperture, thereby providing a path for said air deflected by said insert to exhaust.

5. The reduced icing valve according to claim 4, further comprising an adapter plate disposed between said valve plate and said bypass valves, said adapter plate comprising first and second air paths in fluid communication with said first and second apertures, respectively, and an exhaust vent that is located between said first and second air paths and connects said exhaust aperture to exhaust.

6. The reduced icing valve according to claim 5, wherein said exhaust vent is curvilinear-shaped thereby minimizing the distance between said first and second air paths.

7. The reduced icing valve according to claim 5, wherein said exhaust vent is serpentine-shaped thereby minimizing the distance between said first and second air paths.

8. The reduced icing valve according to claim 5, wherein said adapter plate further comprises pilot signal paths for connecting a pilot valve in fluid communication with said shiftable valve to shift said shiftable valve.

9. The reduced icing valve according to claim 1, wherein said bypass means further comprises a pressure operated check valve closed to exhaust by the supply of compressed air to an associated air motor chamber and open to exhaust thereby permitting return flow of exhaust air from said associated actuating chamber to bypass said shiftable valve, upon ceasing the supply of compressed air.

10. The reduced icing valve according to claim 9, wherein said pressure operated check valve further comprises a deformable elastomeric check coacting with an exhaust port to close said exhaust port upon supply of compressed air and coacting with a supply port to close off said supply port to said shiftable valve upon exhaust of said associated air motor chamber.

11. A reduced icing valve for a reciprocating double diaphragm pump comprising:

a shiftable valve having a pilot piston for shifting said valve for alternatively supplying compressed motive gas through first and second supply ports to opposed first and second opposed diaphragm actuating chambers, respectively, and for effecting alternating exhaust of said chambers;

said shiftable valve being further provided with bypass valves independent of and intermediate said shiftable valve and each of said first and second diaphragm actuating chambers for bypassing said shiftable valve by exhaust gas from said diaphragm actuating chambers, and an insert that deflects, away from said shiftable valve, air entering from each of said bypass valves until said bypass valves are fully actuated by said exhaust gas from said diaphragm actuating chambers; and said bypass valves being further actuated in an opposing direction by a supply source of motive gas to said diaphragm actuating chambers.

12. The reduced icing valve according to claim 11, wherein said air deflected by said insert is ported to exhaust.

13. The reduced icing valve according to claim 11, wherein said insert is a "D" valve.

14. The reduced icing valve according to claim 13, further comprising a valve plate against which said "D" valve slides, said valve plate having first and second apertures in fluid communication with said first and second supply ports, respectively, and an exhaust aperture located between said first and second apertures and connected to exhaust, wherein as said shiftable valve shifts, said "D" valve reciprocates to alternately connect said first and second apertures with said exhaust aperture, thereby providing a path for said air deflected by said insert to exhaust.

15. The reduced icing valve according to claim 14, further comprising an adapter plate disposed between said valve plate and said bypass valves, said adapter plate comprising first and second air paths in fluid communication with said first and second apertures, respectively, and an exhaust vent that is located between said first and second air paths and connects said exhaust aperture to exhaust.

16. The reduced icing valve according to claim 15, wherein said exhaust vent is curvilinear-shaped thereby minimizing the distance between said first and second air paths.

17. The reduced icing valve according to claim 15, wherein said exhaust vent is serpentine-shaped thereby minimizing the distance between said first and second air paths.

18. The reduced icing valve according to claim 15, wherein said adapter plate further comprises pilot signal paths for connecting a pilot valve in fluid communication with said shiftable valve to shift said shiftable valve.

19. The reduced icing valve according to claim 11, wherein said bypass means further comprises a pressure operated check valve closed to exhaust by the supply of compressed air to an associated air motor chamber and open to exhaust thereby permitting return flow of exhaust air from said associated actuating chamber to bypass said shiftable valve, upon ceasing the supply of compressed air.

20. The reduced icing valve according to claim 19, wherein said pressure operated check valve further comprises a deformable elastomeric check coacting with an exhaust port to close said exhaust port upon supply of compressed air and coacting with a supply port to close off said supply port to said shiftable valve upon exhaust of said associated air motor chamber.

* * * * *